US009167877B2

(12) United States Patent
Serres-Vives et al.

(10) Patent No.: US 9,167,877 B2
(45) Date of Patent: Oct. 27, 2015

(54) APPARATUS FOR THE STEAM TREATMENT OF HAIR

(75) Inventors: Gérald Serres-Vives, Eloise (FR); Bénédicte Simond, Marcellaz-Albanais (FR)

(73) Assignee: SEB S.A., Ecully (FR)

( * ) Notice: Subject to any disclaimer, the term of this patent is extended or adjusted under 35 U.S.C. 154(b) by 0 days.

(21) Appl. No.: 12/681,326

(22) PCT Filed: Oct. 2, 2008

(86) PCT No.: PCT/FR2008/001374

§ 371 (c)(1),
(2), (4) Date: May 26, 2010

(87) PCT Pub. No.: WO2009/077673

PCT Pub. Date: Jun. 25, 2009

(65) Prior Publication Data

US 2010/0242986 A1 Sep. 30, 2010

(30) Foreign Application Priority Data

Oct. 3, 2007 (FR) ..... 07 06926

(51) Int. Cl.
*A45D 2/00* (2006.01)
*A45D 1/04* (2006.01)
*A45D 1/00* (2006.01)

(52) U.S. Cl.
CPC *A45D 2/001* (2013.01); *A45D 1/04* (2013.01); *A45D 2001/008* (2013.01)

(58) Field of Classification Search
None
See application file for complete search history.

(56) References Cited

U.S. PATENT DOCUMENTS

| | | | | | |
|---|---|---|---|---|---|
| 1,738,916 | A | | 12/1929 | Murray | |
| 1,836,045 | A | | 12/1931 | Siers | |
| 1,847,735 | A | * | 3/1932 | Van Kirk | 132/206 |
| 3,781,519 | A | | 12/1973 | Martin et al. | |
| 3,947,659 | A | * | 3/1976 | Ono | 392/404 |
| 4,114,022 | A | | 9/1978 | Braulke, III | |
| 4,166,473 | A | * | 9/1979 | Bauer et al. | 132/272 |
| 4,341,229 | A | * | 7/1982 | Bauer et al. | 132/211 |
| 4,632,133 | A | * | 12/1986 | Losenno | 132/231 |
| 4,911,185 | A | * | 3/1990 | Losenno | 132/211 |
| 5,263,501 | A | * | 11/1993 | Maznik | 132/211 |
| 5,781,691 | A | * | 7/1998 | Kwok | 392/405 |
| 5,913,315 | A | | 6/1999 | Todd | |
| 6,119,702 | A | * | 9/2000 | Habibi | 132/224 |
| 6,941,955 | B2 | | 9/2005 | Yao | |
| 7,178,531 | B2 | * | 2/2007 | Carballada et al. | 132/224 |
| 7,380,556 | B2 | * | 6/2008 | Carballada et al. | 132/224 |

(Continued)

FOREIGN PATENT DOCUMENTS

| | | |
|---|---|---|
| CN | 2715596 Y | 8/2005 |
| EP | 1396208 A1 | 3/2004 |

(Continued)

*Primary Examiner* — Joseph M Pelham
(74) *Attorney, Agent, or Firm* — The Webb Law Firm

(57) ABSTRACT

An apparatus for the steam treatment of hair, comprising a housing including a liquid tank, a means for supplying a steam generator with liquid, one or more openings for dispensing the steam thus generated towards a lock of hair, and a hair shaping device that comprises at least one treatment surface provided with heating means and brought into contact with a lock of hair. The steam generator includes a heating member that is thermally independent from said treatment surface.

13 Claims, 5 Drawing Sheets

(56) References Cited

U.S. PATENT DOCUMENTS

| | | | | |
|---|---|---|---|---|
| 7,465,904 | B2 * | 12/2008 | Kim et al. | 219/222 |
| 2003/0127105 | A1 * | 7/2003 | Fontana | 132/200 |
| 2004/0000319 | A1 * | 1/2004 | Carballada et al. | 132/224 |
| 2004/0045570 | A1 | 3/2004 | Yao | |
| 2004/0129288 | A1 | 7/2004 | Saida et al. | |
| 2005/0061352 | A1 * | 3/2005 | Yao | 132/225 |
| 2006/0108344 | A1 * | 5/2006 | Kim et al. | 219/225 |
| 2006/0144414 | A1 * | 7/2006 | Carballada et al. | 132/224 |
| 2008/0189951 | A1 | 8/2008 | Molema et al. | |
| 2012/0111356 | A1 * | 5/2012 | Vacheron et al. | 132/228 |

FOREIGN PATENT DOCUMENTS

| | | | |
|---|---|---|---|
| EP | 1652445 | A1 | 5/2006 |
| EP | 1967088 | A1 | 9/2008 |
| FR | 3004081 | A1 * | 10/2014 |
| WO | 0049906 | A2 | 8/2000 |
| WO | 03077702 | A2 | 9/2003 |
| WO | 2004002262 | A1 | 1/2004 |
| WO | 2004002263 | A1 | 1/2004 |

* cited by examiner

APPARATUS FOR THE STEAM TREATMENT OF HAIR

BACKGROUND OF THE INVENTION

1. Field of the Invention

The present invention relates to an apparatus for the treatment and/or shaping of hair employing means for generating steam and a heating hair shaping device provided for untangling, styling, or setting hair in connection with steam.

2. Description of Related Art

Apparatuses for the steam treatment of hair are known to the prior art, such as disclosed in WO 2004/002262, in which the apparatus is a flat iron consisting of two jaws that are elastically jointed at one of their ends. According to this document, the steam generating means form a sandwich structure, which is contained in one of the jaws. More particularly, one jaw has a tank for the treatment liquid, which impregnates a lock of hair placed in contact with the heating element of the jaw for vaporizing said liquid, which then passes through openings provided for this purpose in the treatment surface designed to contact the hair. This apparatus has its limits when separating the steam treatment from the heat treatment is desired, as the hair is subjected to contact with the hot treatment surface during the generation of steam. Furthermore, the structure of such a jaw is complex and not only requires a compact dimensioning of its components, but above all good insulation of its electric components due to the arrangement of the steam generation means in close proximity to the electric heating elements.

The object of the present invention is to remedy, at least partially, these disadvantages and to propose a hair treatment apparatus capable of rapidly moisturizing the treated hair in a controlled, effective, and uniform manner, while being able to separate the moisturization from a possible supplemental supply of heat and/or mechanical tensioning and/or chemicals.

Another object of the invention is an apparatus for the steam treatment of hair capable of being used effectively in a plurality of hair shaping procedures, wherein said apparatus is designed for the homogeneous dispensing of steam to the hair, has a simplified structure, and is safe to operate.

Another object of the invention is an apparatus for the steam treatment of hair which is reliable in operation, which is designed to avoid condensation, and which can be manufactured easily and economically.

SUMMARY OF THE INVENTION

These objects are achieved with a steam hair treatment apparatus comprising a housing consisting of a liquid tank, means for supplying liquid to a steam generator, one or a plurality of openings for dispensing the steam generated to a lock of hair, and a hair shaping device comprising at least one treatment surface coming into contact with a lock of hair and comprising heating means, characterized in that the steam generator comprises a heating element that is thermally independent of said treatment surface.

A hair shaping device is understood to mean a device designed to come into contact with hair, at least temporarily and/or locally, in order to untangle it, style it or simply keep it in contact with a treatment surface such as, for example: a flat iron with jointed mobile or fixed arms, a curling iron with a cylindrical heating mandrel possibly cooperating with at least one heating plate oppositely arranged relative thereto, a straightening head comprising a plurality of parallel treatment surfaces arranged side by side, etc.

Thermally independent is understood to mean a steam generator equipped with a heating element dedicated to steam generation and separate from the shaping device, which comprises its own heating element.

The steam generator thus configured makes it possible to provide a significant, continuous steam flow instantaneously to the lock of hair being treated, and to do so independently of the temperature of the treatment surface, even for a low temperature of the treatment surface, thus achieving a durable and thorough treatment of the treated lock of hair, for example a straightening, curling, or crimping thereof.

In fact it was observed that treating a lock of hair with a device exerting a thermal action in addition to the mechanical action after the steam application prevents the hair from drying out, as the hair is pre-coated with a layer of moisture. Obviously this layer is evaporated during the styling, but it rather than the water contained in the core of the hair is evaporated, and thus the hair is protected from any desiccation linked to the application of a hot hair shaping device.

Likewise, when steam is applied to a lock of hair after shaping by a device exerting a thermal action, even in combination with a mechanical action on the lock of hair, the steam remoisturizes the hair in order to compensate for the desiccation linked to the application of a hot instrument to the hair.

The steam dispensing opening or openings are advantageously adjacent to the hair shaping device.

"Dispensing openings adjacent to the hair shaping device" is understood to mean one or a plurality of steam outlet openings arranged in the vicinity of the edge of the hair shaping device, in other words, next to and as close as possible to the entrance or to the exit for the lock of hair of the device for shaping the hair.

Through such an arrangement, the steam is prevented from reaching the interior of the device, thus effectively separating the steam treatment function from another hair shaping function such as, for example, a treatment involving the application of heat and/or tension or pressure to the hair, and/or a hairstyling product such as a fixation agent, etc.

During numerous laboratory tests, it was observed that when dispensing a controlled flow of steam either to locks of hair in the natural state or to locks of hair coated with cosmetics, much better results were obtained with a steam application separate from that of another treatment to the tested lock. Hence the tests showed that the steam alone had already well prepared the hair for a subsequent treatment, for example, by cleaning it and uniformly moisturizing it. It was also observed that, by dispensing steam after a hair shaping treatment, the hair is moisturized in a more controlled manner and it retains its shaping for a longer time, with remarkable results in terms of its appearance, particularly sheen and color, which were uniform throughout.

Preference is given to the apparatus of the invention comprising a deflector oppositely arranged relative to the dispensing openings or openings.

By being oppositely positioned relative to the steam outlet, this deflector functions as a steam shield for protecting the scalp of the person receiving the treatment on one hand and for redirecting the steam to the back of the lock on the other hand, thus treating the lock on both of its sides with a steam outlet located on only one of its sides. This deflector can be associated with the housing of the apparatus or integrally formed with the hair shaping device.

Advantageously, the steam path is defined via a plurality of openings uniformly distributed parallel to the generally elongate treatment surface of the hair shaping device, which aim the steam in a direction perpendicular to that of their hair shaping by said device.

The direction of the hair shaping is generally defined by the generally elongate treatment surface of the hair shaping device, a surface that generally treats the width of a lock of hair with its longest side. A steam path arriving perpendicular to the width of a lock of hair hence enables a quick and moreover, a homogeneous treatment of the lock of hair when the steam is dispensed by outlet openings covering the width of the lock.

Preference is given to the steam generator comprising a vaporization chamber in thermal contact with an electric heating element and to the apparatus comprising one or a plurality of pipes less than 3 cm long in each case connecting the vaporization chamber outlet to the dispensing opening or openings.

Preference is given to the apparatus being portable, which permits the arrangement of the steam outlet as closely as possible to the steam generation means of the housing in order to eliminate condensation while simplifying the construction of the apparatus and making it easier to manipulate.

The vaporization chamber is thus positioned as closely as possible to the steam dispensing or outlet openings, hence making it possible to steam treat the lock of hair directly from the outlet of the vaporization chamber via one or a plurality of pipes. As these steam pipes exiting the vaporization chamber are very short in length, they dispense the steam in such a way that condensates cannot form, which could otherwise interfere with and/or cancel the action of the steam on the lock or impair the utility of the apparatus, as the condensates in a worst case scenario could burn the person who is using the apparatus.

Advantageously, the steam generator produces a steam flow greater than 5 g/min, preferably in the range of between 10 g/min and 60 g/min.

The apparatuses for the steam treatment of hair known to the prior art only generate a rather weak steam flow, which does not ensure a visible and/or durable effect on the hair. The apparatus of the invention achieves an effective treatment of the hair when a steam flow greater than 5 g/min and preferably in the range of between 10 g/min and 60 g/min is generated.

Preference is given to the apparatus having a control device for adjusting the flow rate of liquid supplied to the generator.

Such a device for regulating the flow rate of liquid supplied by the pump to the vaporization chamber makes it possible to adapt the flow rate of the steam generated to the type of treatment and/or to the type of hair being treated with the apparatus.

Preference is given to the hair shaping device comprising controls for the heating elements of the treatment surface that are independent from the controls for the steam.

This makes it possible to separate the two functions, enabling the operating parameters for each function to be adjusted independently.

The hair shaping device is advantageously detachable from the housing of the apparatus.

This constitutes a simple and cost-effective solution for enabling the apparatus to be used with the same device, or even with a plurality of hair shaping devices, by either a left-handed or a right-handed person.

Preference is given to the liquid contained in the tank being a treatment product.

Treatment liquid is understood to mean any liquid capable of being vaporized by the generator and then capable of being applied to the hair in vapor form for a care process, a shaping, a colorization, a decolorization, etc. This liquid is water in a preferred embodiment of the invention.

In another embodiment of the invention, the apparatus has a supplementary liquid tank adjacent to or associated with the hair shaping device.

This supplementary tank may thus be associated with either the apparatus or the hair shaping device and it allows a liquid that is not necessarily vaporized by the steam generator of the apparatus to be applied to the hair, for example, during an application in which the liquid from the supplementary tank is brought into contact with the treated lock.

Advantageously, the liquid contained in the supplementary tank is different from the liquid contained in the tank for supplying the steam generator.

This makes it possible to apply a cosmetic liquid, such as a hairstyling or colorization agent, in addition to the steam treatment.

Hence, in the case wherein the cosmetic was applied prior to the steam application, the steam serves as a transport medium for the cosmetic, enabling it to penetrate to the core of the hair via the opening of the scales, wherein the subsequent mechanical treatment closes the scales again and performs a type of cauterization of the hair to fix the cosmetic.

Furthermore, in the case wherein the cosmetic was applied after the mechanical and thermal treatment of the hair, the steam is used as a transport medium, thus protecting the cosmetic from exposure to very high temperatures and thus from thermal degradation.

In a first alternate embodiment of the invention, said dispensing openings are adjacent to the hair shaping device and disposed upstream relative thereto.

"Upstream" is understood to mean that, in the treatment operation, a portion of the lock of hair first undergoes the steam application before undergoing the shaping treatment.

Tests performed by treating a lock of hair with steam emitted upstream of the hair shaping device have shown that the steam opens the scales of the hair and thoroughly cleans it. The mechanical action subsequently exerted by the hair shaping device rids the hair of any remaining impurities, such as those from an earlier treatment and/or care process.

The laboratory tests also showed that the steam emitted upstream of the hair shaping device, when the latter comprises a cosmetic dispensing system, enhances the penetration of said cosmetic into the interior of the hair, thus improving the deep-penetrating action of said cosmetic.

It has also been observed that treating the lock of hair with a device exerting a thermal action in addition to the mechanical action after the steam application keeps the hair from drying out, as the hair is pre-coated with a layer of moisture. Obviously this layer is vaporized during the styling process, but it rather than the water contained in the core of the hair is vaporized, thus protecting the hair from any desiccation linked to the application of a hot hair shaping device.

Lastly, the laboratory tests also showed that the steam emitted upstream of the hair shaping device sufficiently moisturizes the hair, thus protecting it from significant desiccation during the action of the hair shaping device, which may be heated to a high temperature, for example, 230° C.

In a second alternate embodiment of the invention, said dispensing openings are adjacent to the hair shaping device and disposed downstream thereof.

"Downstream" is understood to mean that, in the treatment operation, a portion of the lock of hair first undergoes the shaping treatment before undergoing the steam application.

Tests performed with an apparatus configured according to this variant of the invention have shown that, after a mechanical shaping of the lock, the steam remoisturizes the hair to compensate for the desiccation linked to the application of the hot treatment surface of a shaping device on the hair.

Advantageously, the housing comprises a body that extends downwards to form a handle, wherein the hair shaping device is oppositely arranged relative to the handle and the steam path exiting from the dispensing openings is aligned along the longitudinal axis of the body of the housing.

Such a configuration of the housing ensures both ergonomic use and effective treatment of the hair by the steam.

In a preferred embodiment of the invention, the hair shaping device has two jointed arms displaceable in opposite directions and in each case having a hair treatment surface, wherein at least one of the arms has a heating element in thermal contact with said treatment surface.

Such a device ensures an effective, long-lasting straightening of the hair.

For the sake of ergonomics, the jointed arms are pivot-mounted about an axis appreciably parallel to that of the handle of the apparatus.

BRIEF DESCRIPTION OF THE DRAWINGS

The invention will be more easily understood by studying a special embodiment of the invention, which is in no way limiting and is illustrated in the appended figures, wherein.

DETAILED DESCRIPTION OF THE INVENTION

Figure 1:
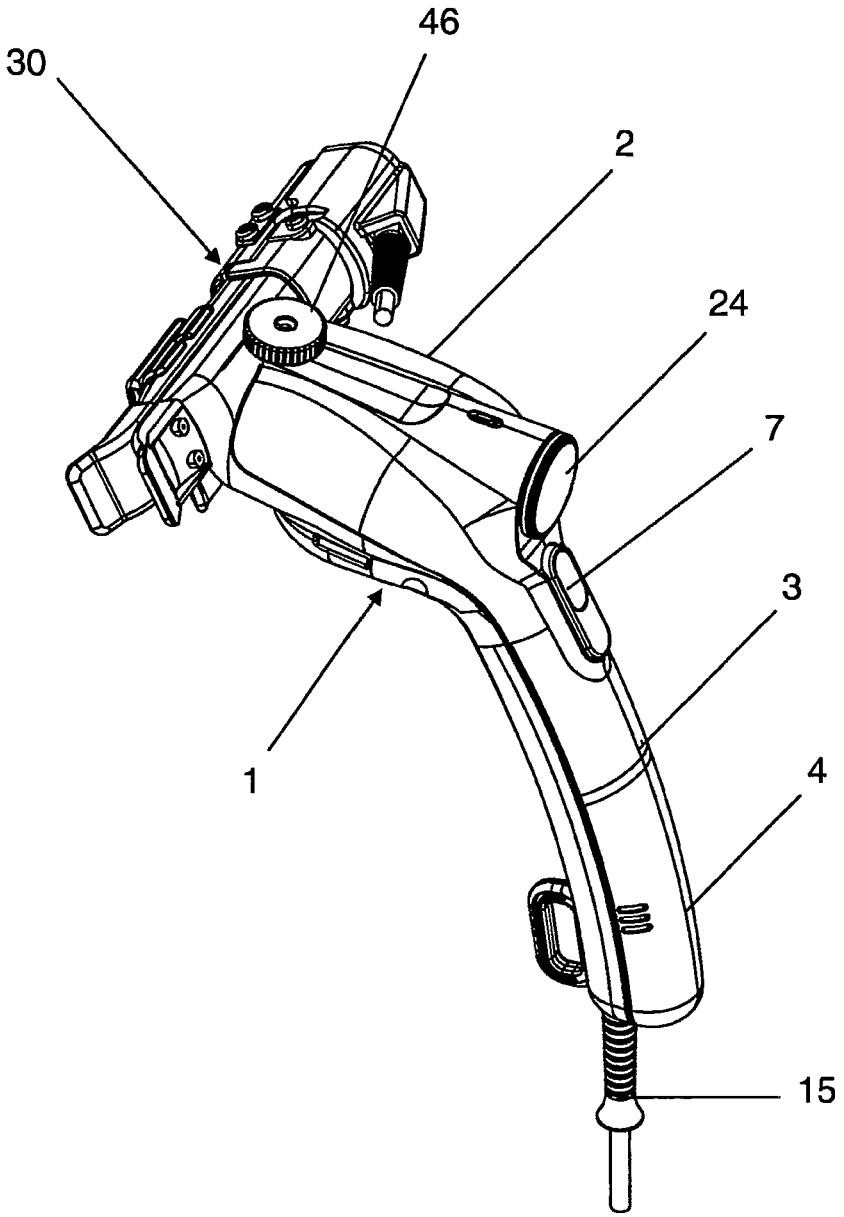
FIG. 1 is a perspective view of an apparatus for the steam treatment of hair according to a special embodiment of the invention, with the hair shaping device in the closed position.

FIGS. 1 through 3 and 5 illustrate an apparatus for the steam treatment of hair consisting of a plastic housing 1 comprising a body 2 with a downwardly projecting extension forming a handle 3 receiving a detachable water tank 4 of which the top wall forms the top part of the handle. The extension of the housing 1 also contains means 6 for supplying a steam generator 8 contained in the body 2 of the housing 1, notably an electric pump 5, which can be discerned in FIG. 3 and which is started by a control switch 7. The body 2 of the housing 1 contains a steam generator 8 consisting of an instantaneous vaporization chamber 10 associated with an electric heating element 9; these elements can be discerned in FIG. 3. The instantaneous vaporization chamber 10 generally comprises an enclosed compartment equipped with a plurality of baffles for directing fluid from a water inlet to the steam outlet openings of the chamber. Electric power is supplied to the apparatus by an electric cord 15.

Figure 3:
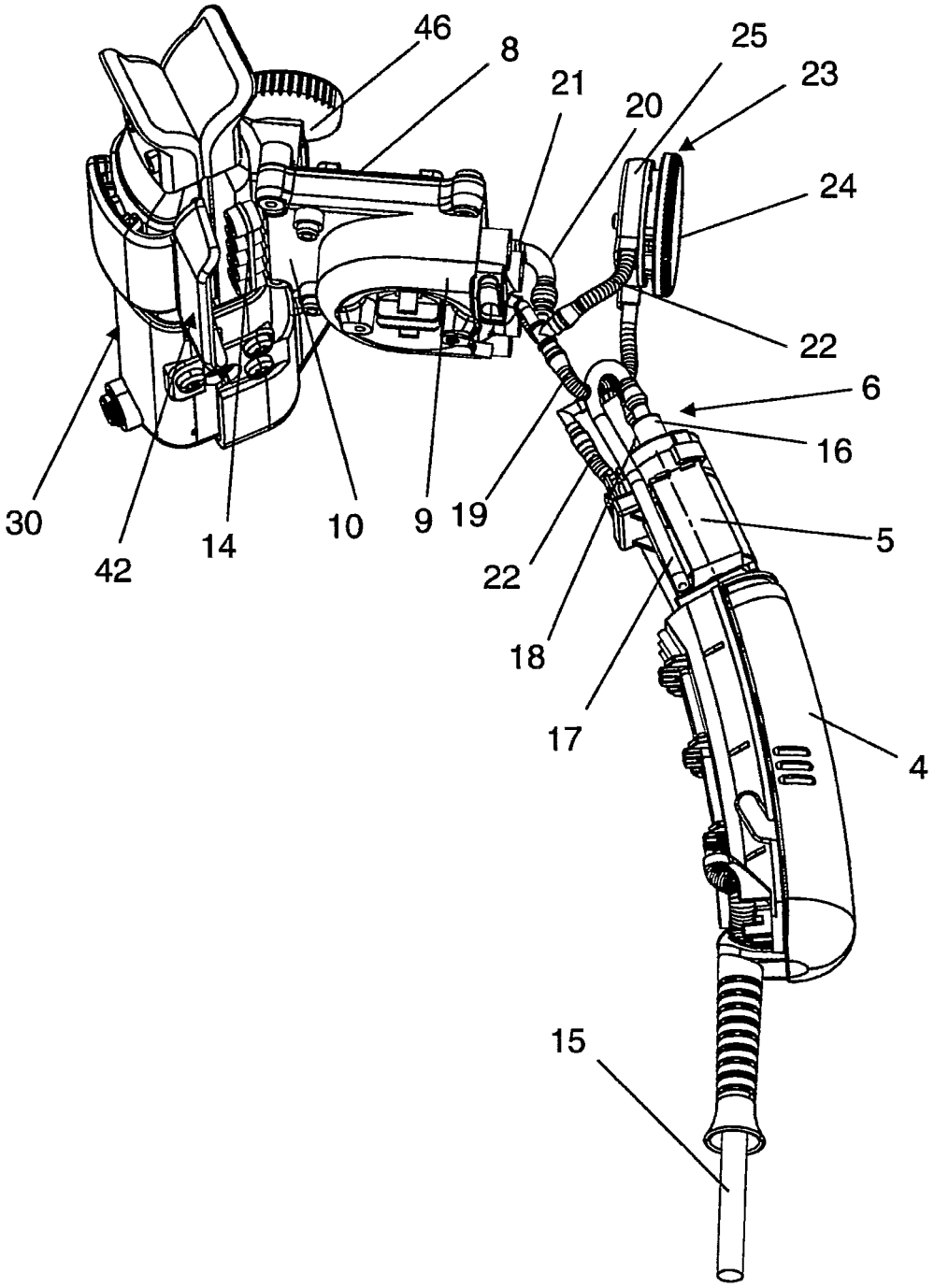
FIG. 3 is a perspective view of the apparatus of FIG. 1, with its housing removed.

The circuit connecting the electric pump 5 to the tank 4 and to the generator 8 can be discerned in FIG. 3. The electric pump 5 hence has an inlet opening 16 connected by a first pipe 17 to the tank 4 and a discharge opening 18 directing the water coming from the tank 4 through a circuit supplying the steam generator 8. More particularly, the circuit supplying the steam generator 8 comprises a second pipe 19 leading to a junction dividing the supply circuit into a first pipe branch 20 connected to an inlet opening 21 in the vaporization chamber 10 of the steam generator 8 and a second pipe branch 22 connected to the tank 4 and allowing a portion of the water coming from the pump 5 to be piped to the tank 4. The passage of the first pipe branch 20 is smaller than that of the second pipe branch 22, the latter being made of a flexible hose, the apparatus further comprising a mechanism 23 for controlling the flow of the water piped into the generator 8. The control mechanism 23 comprises means for compressing the flexible hose of the second pipe branch 22, which passes through a cylindrical housing 25. More particularly, by turning a knurled knob 24 the control mechanism 23 actuates a toggle lever inside the housing 25, which lever presses on the outer surface of the flexible hose.

When the pump 5 is started by the control switch 7, it sucks the water from the tank 4 via the first pipe 17 and pipes the water via the second pipe 19, the water flow conducted by this circuit thus being divided into a first, weak flow piped to the generator 8 and a stronger flow piped to the tank. The flow of water to the generator 8 can be increased by turning the knob 24 to compress the return hose to the tank 4.

The water flowing into the vaporization chamber 10 is rapidly turned into steam by the latter as it flows along the path of the baffles of the instantaneous vaporization chamber 10. The steam exits the vaporization chamber 10 via a plurality of openings formed in a back wall of said vaporization chamber opposite the wall accommodating the inlet opening 21. Each of the steam outlet openings of the vaporization chamber 10 communicates with a pipe 14 for dispensing the steam outside the apparatus. In FIG. 3 it is hence possible to discern five short pipes 14, each of which is, for example, ca. 1 cm long, enabling the steam to be dispensed immediately after exiting the vaporization chamber 10.

Figure 2:
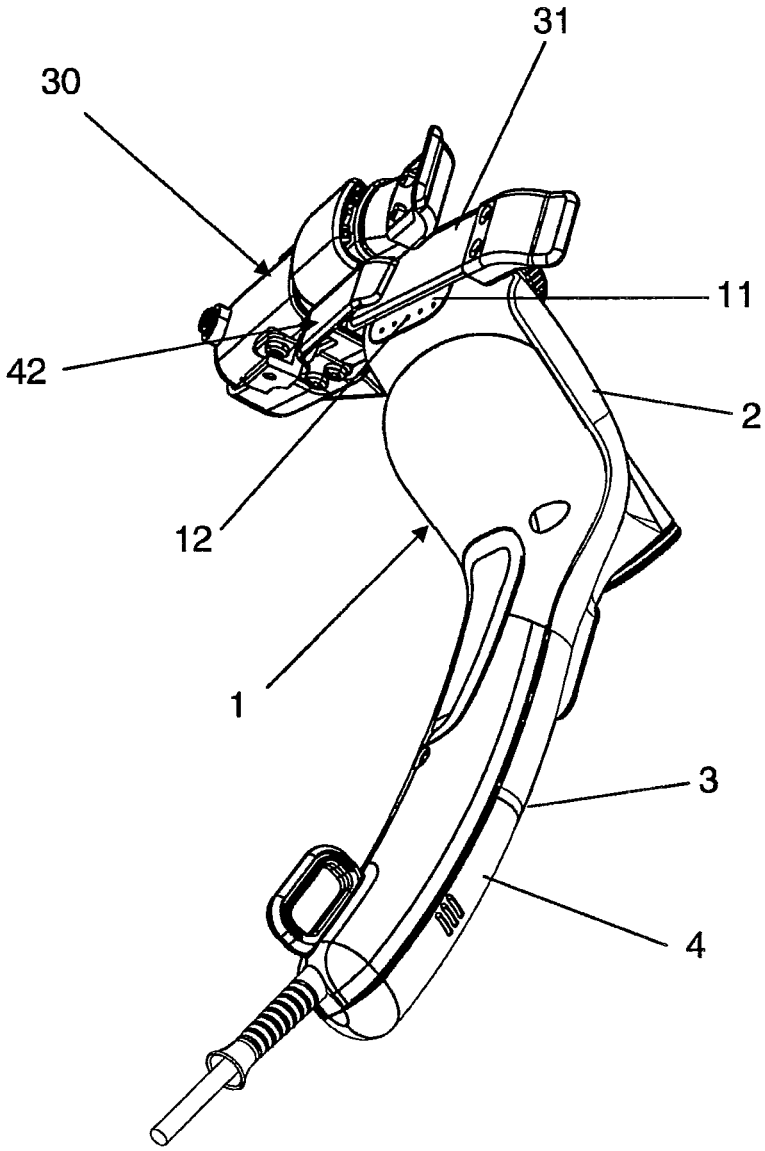
FIG. 2 is a perspective view of the apparatus of FIG. 1, with the hair shaping device in the open position.

As can be discerned more clearly in FIG. 2, the bottom part of the body 2 of the housing 1 on the side opposite the handle 3 is closed by a flat side 11 having a plurality of steam dispensing openings 12, each of which openings communicates with the outlet of a pipe 14.

The steam dispensing openings 12 are adjacent to a hair shaping device 30. Hence the top part of the body 2 advantageously receives the hair shaping device 30, the latter having at least one treatment surface 31 located in the extension parallel to, even set back a few millimeters from, the flat side 11 of the housing 1.

Figure 4:
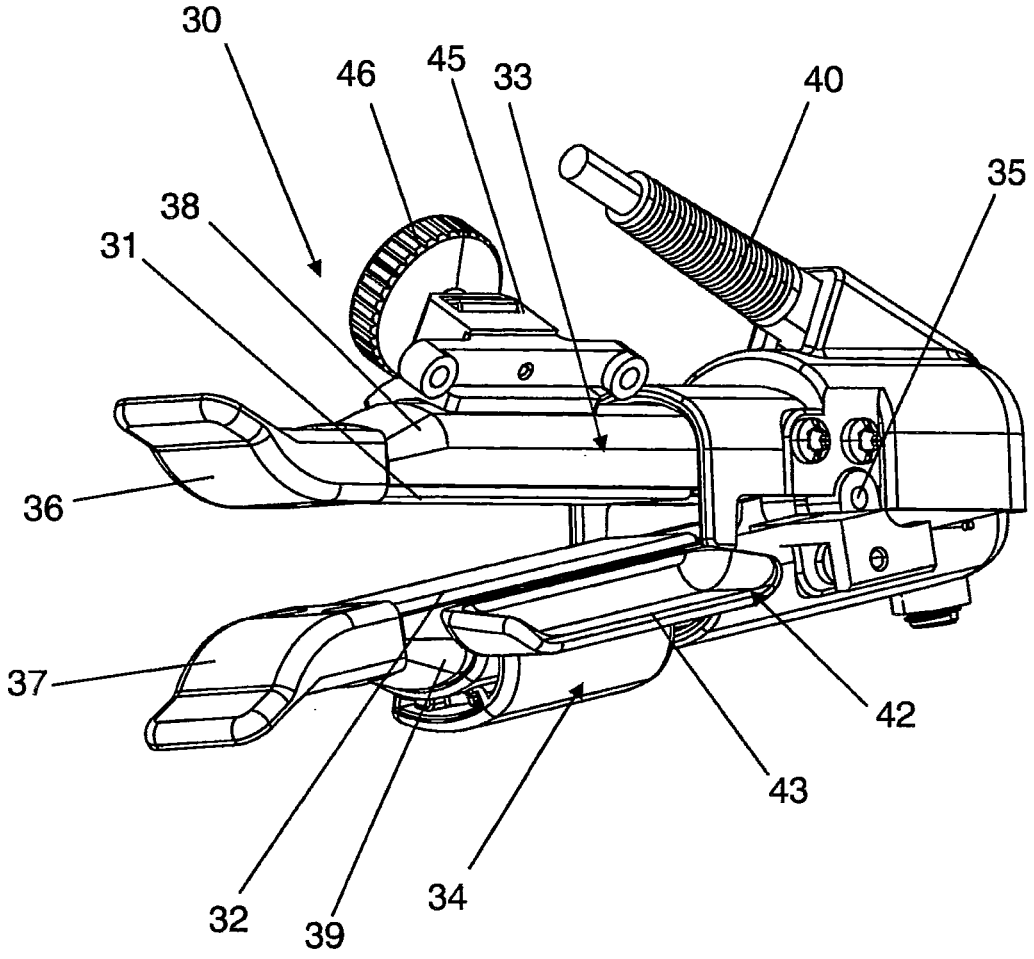
FIG. 4 is a perspective view of a hair shaping device of the apparatus of the preceding figures.

The hair shaping device 30 can be more easily discerned in FIG. 4 and it comprises two arms 33, 34 joint-mounted about a hinge 35 and held in an open position, or in a closed position in a variant, by a compression spring (not shown in the drawings). It is hence possible to discern a top arm 33 having, on its free end, a flared insertion shoe 36 that extends to form a flat, rectangular treatment surface 31 in contact with heating means constituted by a heating element. On its free end, the bottom arm 34 likewise has a flared insertion shoe 37 that extends to form a flat, rectangular treatment surface 32 in contact with a heating element.

Each treatment surface 31, 32 is constituted by a metal plate that makes thermal contact with an electric heating element (not shown in the drawings), which can be a resistance, CTP, infrared, etc. heating element and which is positioned against the treatment surface and inside the plastic bodies 38 and 39, respectively, of each arm 33, 34.

According to the invention, the steam generator 8 hence comprises a heating element 9 which is thermally independent of each treatment surface 31, 32, wherein each of said surfaces comprises its own heating element.

Each electric heating element has its own controls and is supplied with electricity by an electric cord 40. Provision is made of the heating element for heating the plates to temperatures ranging from 90° C. to 230° C. In a variant, the apparatus has a single electric cord 15 for supplying electricity to the steam generator 8 and to the heating plates of the hair shaping device 30. The treatment surface 31, 32 is made of a heat conducting material and may be polished, coated with an enamel, a ceramic material, a layer of glass, etc.

The arms 33, 34 are hence elastically mobile and capable of pivoting about an axis perpendicular to the longitudinal axis of their respective treatment surfaces 31, 32 between an open and a closed position. Hence a lock of hair can be inserted between the treatment surfaces 31, 32 of the arms 33, 34 when the arms are in the open position, and the lock can then be subjected to pressure in order to bring it into contact with said treatment surfaces 31, 32 when the arms are in the closed position, which closing is possible by pressing on the outer surface of the bodies 38, 39 of the arms. The flat treatment surfaces 31, 32 thus straighten the lock with which they come into contact.

In another alternate embodiment of the hair shaping device 30, the jaws are closed at rest and it is necessary to introduce the lock manually between the treatment surfaces 31, 32 by stretching it out and then pushing it between the two plates with the aid of the insertion shoes 36, 37. Advantageously, a control mechanism for opening the plates wide enough so that the lock can be more easily inserted is conceivable, wherein said mechanism could be actuated, for example, from the handle or in the vicinity of the handle of the apparatus.

According to an advantageous aspect of the invention, the bottom arm 34 comprises a deflector 42 in turn comprising a wall 43 arranged set back from, but parallel to the treatment surface 32. The wall 43 forms a steam shield that protects the scalp from the action of the steam while diverting the steam towards the lock of hair being treated. Another advantage of diverting the steam in this manner is that the front and the back of the lock can be impregnated with steam from a steam outlet arranged on just one side.

According to another advantageous aspect of the invention, the top arm 33 has a mounting bracket 45 on the body 2 of the housing 1 of the apparatus, more particularly a fastener that can be detached by means of a screw 46 cooperating with a threaded borehole in the top part of the body 2 of the apparatus. This detachable fastener makes it possible, by unscrewing the screw 46, to switch from a positioning that is suitable for use by a right-handed person, as shown in the figures, to another positioning wherein the device is rotated 180° about the longitudinal axis of the body 2 for enabling a left-handed person to use the apparatus. This hair shaping device can be replaced by another device, such as one comprising a cylindrical curling element cooperating with a pivoting fastening clip for the hair, with this device then being inserted in the mounting bracket 45 and attached to the body 2 of the housing 1 of the apparatus.

Figure 5:
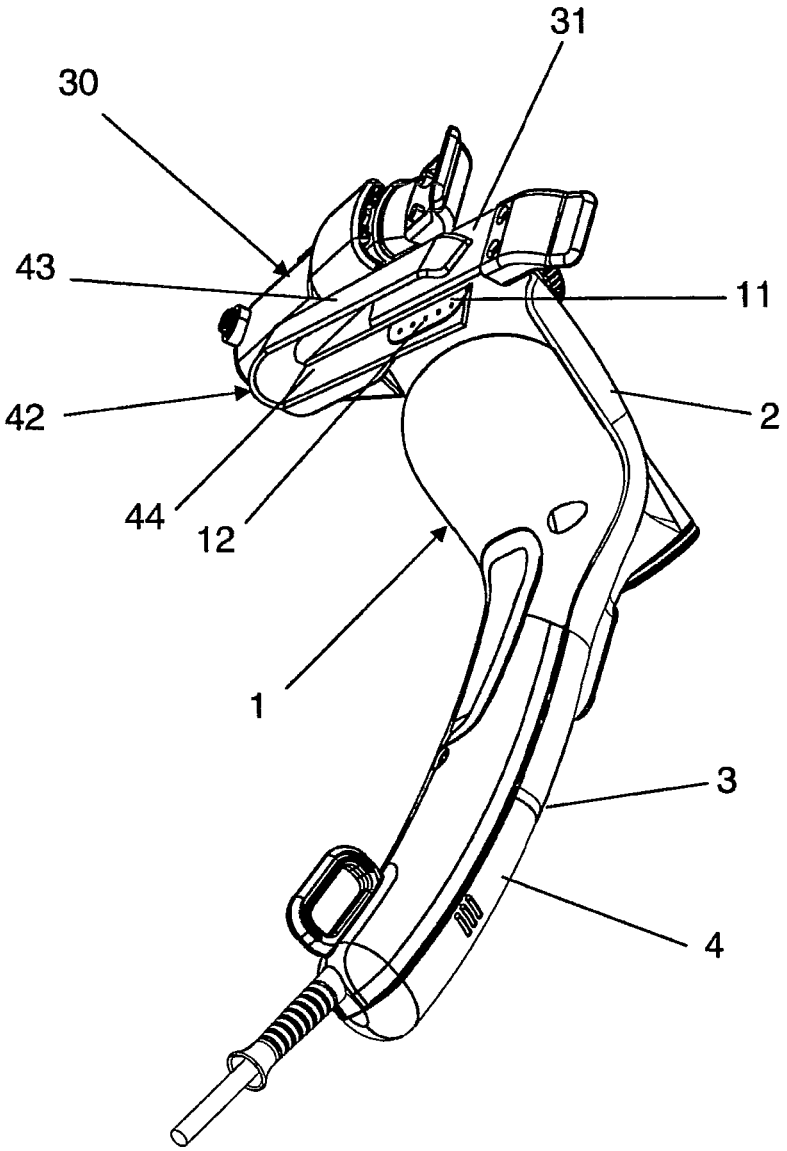
FIG. 5 is a perspective view of the apparatus for the steam treatment of hair according to a variant of the embodiment of the apparatus of FIG. 1.

FIG. 5 illustrates an alternate embodiment of the deflector 42, notably by solidly connecting it to the body 2 of the housing 1 of the apparatus. More particularly, the deflector 42 has the general shape of a tuning fork and comprises a back wall 44 penetrated by dispensing openings 12 and extending to form an elbow connecting it to a deflection wall 43 spaced apart from said back wall. The deflection wall 43 is disposed remotely from and parallel to the back wall 44 and ends in a tip that curves back towards the latter. Such a deflector allows a lock of hair to pass between its parallel walls while protecting the scalp, and at the same time ensures that the steam is directed to the lock via the deflection wall. Advantageously, such a deflector can be made of plastic.

In operation, the hair shaping device 30 is turned on by pressing a control switch, and a light (not shown in the drawings) can indicate when the heating plates have reached the correct temperature. A lock of hair is then introduced between the arms 33, 34 of the hair shaping device 30 applying a pressure force to the lock, then the control switch 7 is pressed, and the apparatus starts to generate steam instantaneously. The apparatus is then moved along the lock, administering a steam treatment followed immediately by a straightening through contact with the treatment surfaces 31, 32 of the hair shaping device.

Because the controls of the device are independent from those of the apparatus, the latter can also be used with the straightening plates at ambient temperature or very slightly heated. This makes it possible to clean the lock, simultaneously ridding it of impurities and moisturizing it.

In a variant that is not shown in the drawings, the steam dispensing openings are located above the hair shaping device, in order to start with a straightening prior to the steam treatment.

Obviously, the invention is in no way limited to the embodiment described and illustrated, which was presented solely by way of an example. Modifications are possible, notably in terms of the constitution of the various elements or by substituting equivalent techniques, without exceeding the scope of protection for the invention in any way.

The invention claimed is:

1. An apparatus for the steam treatment of hair comprising:
- a liquid tank,
- means for supplying liquid for a steam generator,
- one or a plurality of openings for dispensing the steam generated to a lock of hair, and
- a hair shaping device comprising a first arm and a second arm jointed together and displaceable in opposite directions, each arm having a generally elongate treatment surface comprising heating means and coming into contact with a lock of hair, wherein the steam generator comprises a heating element that is thermally independent of said treatment surface, and wherein the steam dispensing opening or openings are arranged on an edge of the first arm of the hair shaping device, and
- a steam deflector extends laterally outward from an edge of the second arm of the hair shaping device positioned opposite the openings for dispensing steam arranged on the edge of the first arm.

2. The apparatus as in claim 1, wherein a steam path extends from a plurality of uniformly distributed openings aligned adjacent to the generally elongate treatment surface of the hair shaping device in a direction perpendicular to the generally elongate treatment surface of the hair shaping device.

3. The apparatus as in claim 1, wherein the steam generator comprises a vaporization chamber in thermal contact with an electric heating element and further wherein said apparatus comprises one or a plurality of pipes less than 3 cm long in each case and connecting the outlet from the vaporization chamber to the dispensing opening or openings.

4. The apparatus as in claim 1, wherein the steam generator generates a steam flow greater than 5 g/min.

5. The apparatus as in claim 1, comprising a control device for adjusting the flow of liquid directed to the generator.

6. The apparatus as in claim 1, wherein the hair shaping device comprises controls for the heating means of the treatment surface that are independent of the controls for the steam.

7. The apparatus as in claim 1, wherein the liquid contained in the tank is a treatment product.

8. The apparatus as in claim 1, comprising a supplementary liquid tank adjacent to or associated with the hair shaping device.

9. The apparatus as in claim 8, wherein the liquid contained in the supplementary tank is different from the liquid contained in the tank for supplying the steam generator.

10. The apparatus as in claim 1, wherein the steam generator generates a steam flow in the range of between 10 g/min and 60 g/min.

11. The apparatus as in claim 1, wherein the steam deflector forms a wall having a plane surface that and wherein the deflector is set back from the treatment surface of the second arm of the hair shaping device.

12. The apparatus as in claim 1, wherein the steam deflector forms a wall that is set back from the edge of the second arm of the hair shaping device where hair enters and/or exits the hair shaping device.

13. The apparatus as in claim 8, wherein the supplementary liquid tank is adapted to distribute liquid simultaneously with the liquid contained in the tank for supplying the steam generator.

* * * * *

UNITED STATES PATENT AND TRADEMARK OFFICE

CERTIFICATE OF CORRECTION

PATENT NO. : 9,167,877 B2
APPLICATION NO. : 12/681326
DATED : October 27, 2015
INVENTOR(S) : Gérald Serres-Vives et al.

It is certified that error appears in the above-identified patent and that said Letters Patent is hereby corrected as shown below:

IN THE CLAIMS

Column 9, Line 8, Claim 11, after "surface" delete "that"

Signed and Sealed this
Twenty-ninth Day of March, 2016

Michelle K. Lee

Michelle K. Lee
*Director of the United States Patent and Trademark Office*